United States Patent [19]

Urso

[11] 4,248,519

[45] Feb. 3, 1981

[54] CHARGE CONTROL SYSTEM FOR XEROGRAPHIC MACHINES

[75] Inventor: Charles J. Urso, Webster, N.Y.

[73] Assignee: Xerox Corporation, Stamford, Conn.

[21] Appl. No.: 736,035

[22] Filed: Oct. 27, 1976

[51] Int. Cl.[3] ..... G03G 15/02

[52] U.S. Cl. ..... 355/3 CH; 323/268

[58] Field of Search ..... 96/1 C; 323/21; 355/3 R, 3 CH, 3 DD, 3 BE, 16, 69; 361/225, 229; 430/55, 97

[56] References Cited

U.S. PATENT DOCUMENTS

| | | | |
|---|---|---|---|
| 2,956,487 | 10/1960 | Giaimo | 355/14 |
| 3,586,908 | 6/1971 | Vosteen | 361/229 |
| 3,654,893 | 4/1972 | Piper et al. | 355/3 DD |
| 3,789,223 | 1/1974 | Sato | 96/1 C |
| 3,843,885 | 10/1974 | Sato et al. | 361/229 X |
| 3,944,354 | 3/1976 | Benwood et al. | 355/3 DD |
| 4,008,954 | 2/1977 | Ogawa et al. | 355/3 R |
| 4,026,643 | 5/1977 | Bergman | 355/3 DD |

*Primary Examiner*—A. D. Pellinen

[57] ABSTRACT

Apparatus for controlling the charge level on the photoconductive surface of a reproduction machine to enhance imaging. A corona generator is used to initially charge the photoconductive surface following which the charge is examined and compared with a preselected reference charge. Where an overcharge is found, a lamp, the illumination intensity of which is matched to the degree of overcharge, is actuated to reduce the charge level on the photoconductive surface to substantially the same as the reference charge. Where an undercharge is found, a supplemental charging device is actuated to the degree necessary to bring the charge level up to the reference charge.

1 Claim, 3 Drawing Figures

CHARGE CONTROL SYSTEM FOR XEROGRAPHIC MACHINES

This invention relates to electrostatic reproduction machines, and more particularly to an improved charge control system for use with such machines.

In an electrostatic or xerographic type reproduction machines or copiers, the charge level on the machine photoconductive surface or photoreceptor, is critical to satisfactory operation of the machine. As known to those versed in the art, the photoconductive surface is first charged, desirably to a preset charge level, preparatory to imaging. The level of this initial charge however, is often critical since too low a charge may result in weak, washed out looking copies whereas too high a charge may result in dark copies and over-loading of the machine cleaning mechanism.

Normally the charge as aforesaid is placed on the photoconductive surface by a corona generator. Close control over the corona output of devices of this tye is often difficult, particularly as the machine components including the corona generator age.

It is therefore a principle object of the present invention to provide a new and improved charge control for xerographic type machines.

It is a further object of the present invention to provide an improved charge control wherein the initial charge set down by the corona generator is examined and changed as necessary to provide the optimum charge desired.

It is an object of the present invention to provide an improved mechanism for changing the charge on a photoreceptor surface in response to the existing charge conditions to provide an optimum photoreceptor charge.

It is an object of the present invention to provide a charge control wherein charges on a photoreceptor are automatically tailored in response to existing photoreceptor charge conditions to provide an optimized photoreceptor charge.

This invention relates to an electrostatic type reproduction machine for producing copies of an original, comprising in combination, a photoreceptor; charging means for placing a charge on the photoreceptor in preparation for imaging; exposure means for exposing the charged photoreceptor to the original whereby to create a latent electrostatic image of the original on the photoreceptor; developing means for developing the latent electrostatic image on the photoreceptor; transfer means for transferring the developed image to a sheet of copy material; means for generating a charge level signal reflecting the charge level of the photoreceptor following charging by the charging means; light means for illuminating the photoreceptor to reduce the charge level of the photoreceptor; supplemental charging means for increasing the charge on the photoreceptor; means for monitoring the charge on the photoreceptor to produce a control signal proportional to the degree of overcharge or under-charge of the photoreceptor; and control means for proportionally actuating one of the light means and the supplemental charging means in response to the control signal.

Other objects and advantages will be apparent from the ensuing description and drawings in which.

Figure 1:
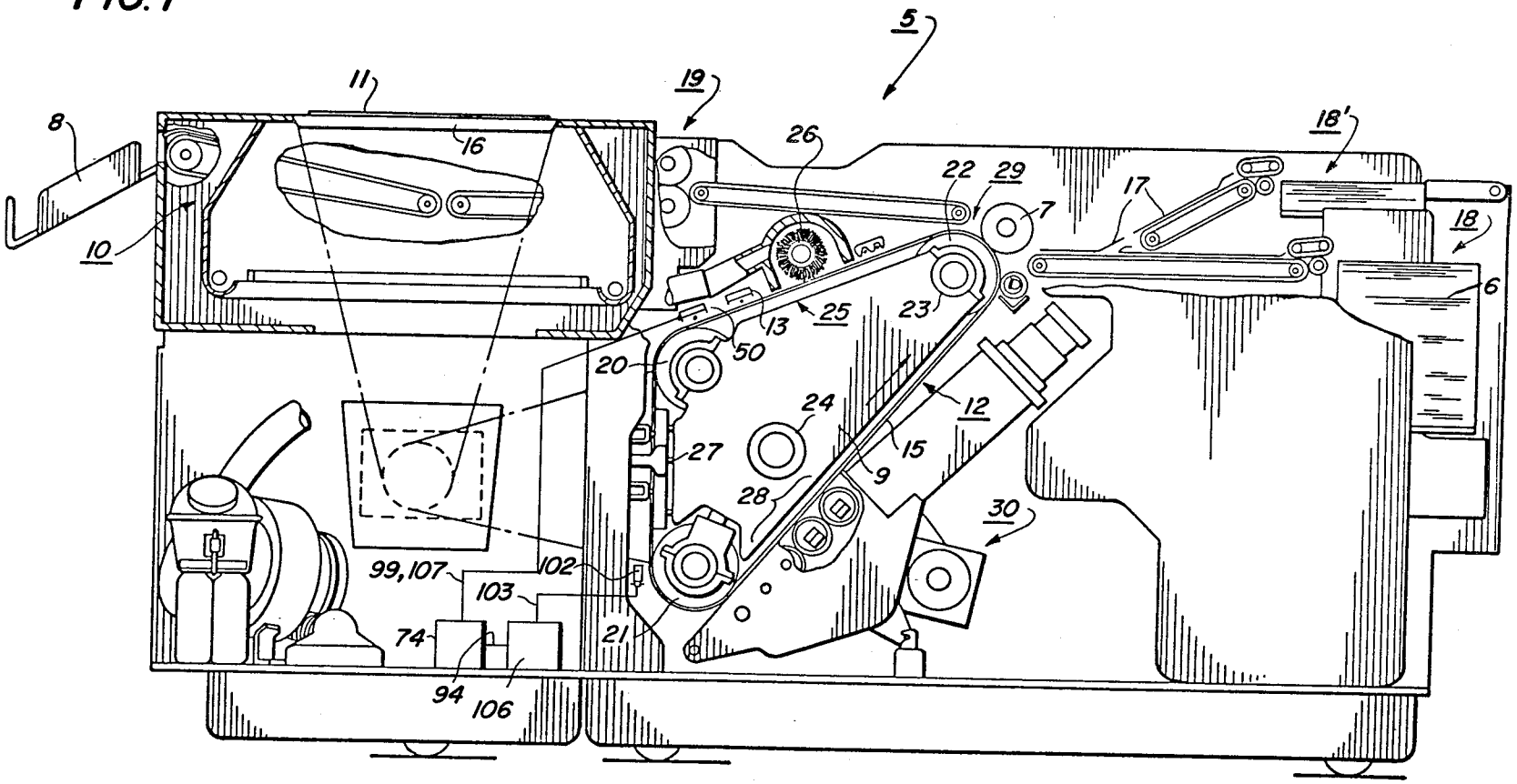
FIG. 1 is a schematic sectional view of an electrostatic reproduction machine incorporating the charge control system of the present invention.

For a general understanding of the invention, an exemplary copier/reproduction machine in which the invention may be incorporated, is shown in FIG. 1. The reproduction or copying machine, is there designated generally by the numeral 5.

A document 11 to be copied is placed upon a transparent support platen 16 fixedly arranged in an illumination assembly, generally indicated by the reference numeral 10, positioned at the left end of the machine 5. Light rays from an illumination system are flashed upon the document to produce image rays corresponding to the information areas. The image rays are projected by means of an optical system onto the photosensitive surface of a xerographic plate in the form of a flexible photoconductive belt 12 arranged on a belt assembly, generally indicated by the reference numeral 9.

The belt 12 comprises a photoconductive layer 15 of selenium which is the light receiving surface and imaging medium for the apparatus, on a conductive backing. The surface of the photoconductive belt is made photosensitive by a previous step of uniformly charging the same by means of a corona generating device 13.

The belt is journaled for continuous movement upon three rollers 20, 21 and 22 positioned with their axis in parallel. The photoconductive belt assembly 9 is slidably mounted upon two support shafts 23 and 24, with the roller 22 rotatably supported on the shaft 23 which is secured to the frame of the apparatus and is rotatably driven by a suitable motor and drive assembly (not shown) in the direction of the arrow at a constant rate. During exposure of the belt 12, the reflected light image of such original document positioned on the platen is flashed on the surface 15 of belt 12 to produce an electrostatic latent image thereon at exposure station 27.

The electrostatic latent image on the moving belt 12 passes through a developing station 28 in which there is positioned a magnetic brush developing apparatus, generally indicated by the reference numeral 30, and which provides development of the electrostatic image by means of multiple brushes as the same moves through the development zone.

The developed electrostatic image is carried on belt 12 to transfer station 29 whereat a sheet 6 of copy paper is fed between transfer roller 7 and belt 12 at a speed in synchronism with the moving belt to transfer the developed image to sheet 6 without blurring. A sheet transport mechanism, generally indicated at 17, brings sheets 6 from paper supply tray 18 or 18' to the transfer station 29 at the proper time to match the arrival of the sheet with the arrival of the developed image on belt 12.

Following transfer, the image bearing sheet is separated from belt 12 and conveyed to a fuser assembly, generally indicated by the reference numeral 19, wherein the developed powder image on the sheet is permanently affixed thereto. After fusing, the finished copy is discharged from the apparatus into a suitable collector, i.e. tray 8. Residual toner particles and any other residue left on belt 12 are removed by brush 26 at cleaning station 25. Further details regarding the structure of the belt assembly 9 and its relationship with the machine and support therefor may be found in U.S. Pat. No. 3,730,623 issued May 1, 1973 and assigned to the same assignee.

As will be understood by those skilled in the art, development of the latent electrostatic image formed on belt 12 is dependent upon the voltage differential between the light image and the developing means. This voltage differential, which may be described as a xerographic development field, serves to attract toner to the latent electrostatic image in accordance with the image outline and density requirements to faithfully reproduce the original being copied.

Figure 2:
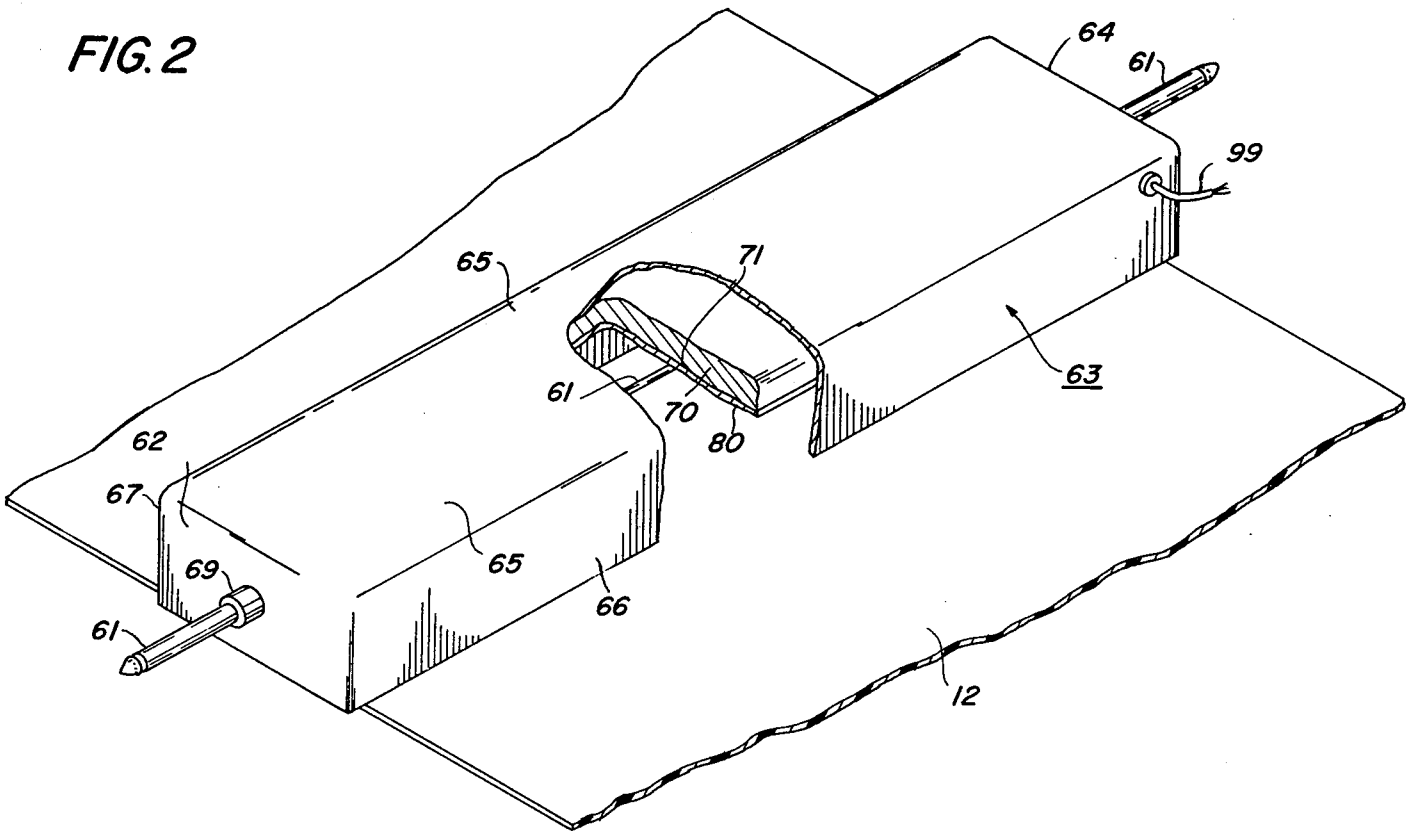
FIG. 2 is an isometric view showing details of the charge control apparatus of the present invention.
Figure 3:
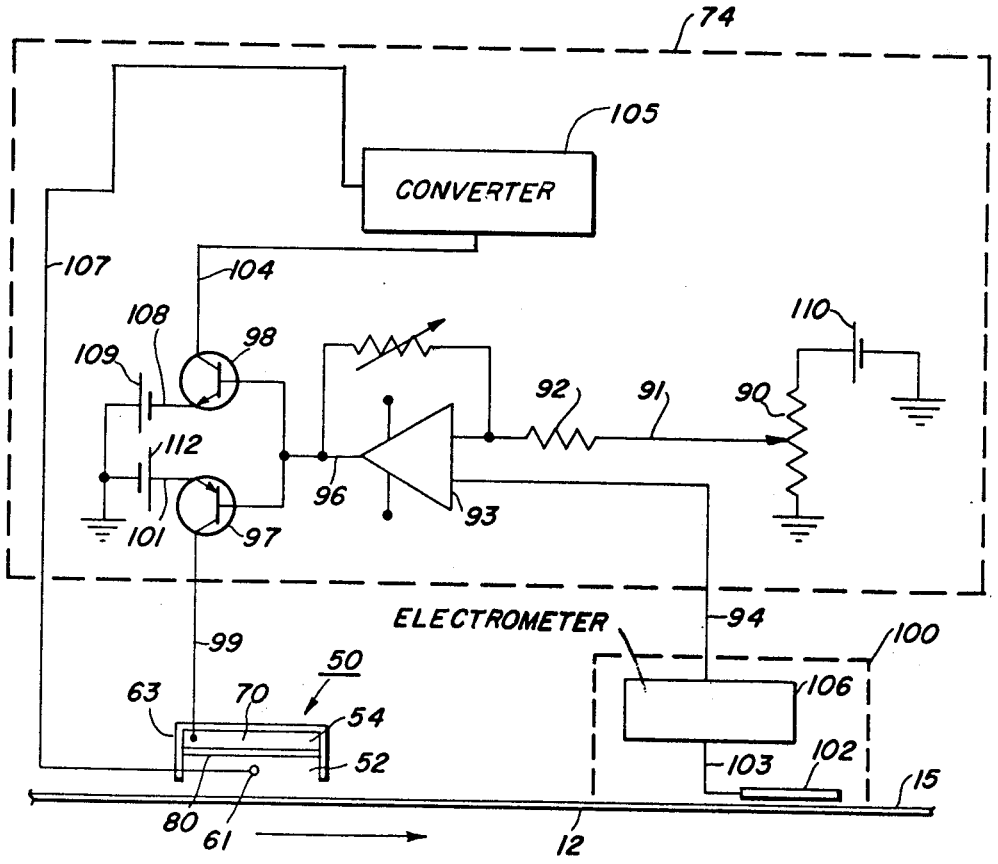
FIG. 3 is a circuit schematic of the photoreceptor charge control system of the present invention.

Referring now to FIGS. 2 and 3 of the drawings, the charge control 50 of the present invention preferably includes both a supplemental charging section 52 and a charge reducing section 54. As will appear, supplemental charging section 52 is utilized to automatically increase the charge level on the photoconductive surface 15 of belt 12 where the original charge level provided by the corona generating device 13 is found to be too low while charge reducing section 54 is utilized to automatically reduce the charge on surface 15 where the original charge is found to be too high. In this way an optimized charge is provided on the photoconductive surface 15.

Supplemental charging section 52 includes a corona discharge wire 61 and adjoining shield 63. Shield 63 is formed from metal and in the arrangement shown, has, when viewed in cross-section, a generally inverted U-shape with top wall 65, depending side walls 66, 67, and end walls 62, 64. Corona wire 61 is strung between end walls 62, 64 of shield 63. To prevent shorting of corotron wire 61 to metal shield 63, suitable electrical insulators 69 are provided between wire 61 and the ends 62, 64 of shield 63. It will be understood that where corotron shield is composed of an electrical insulating material such as plastic, insulators 69 and, as will appear conductive layer 80, may be dispensed with.

Charge reducing section 54 of charge control device 50 includes a generally rectangular electro-luminescent panel 70, the length and width dimensions of which are equal to or slightly less than the corresponding length and width dimensions of shield 63, mounted within the shield interior on the inside surface of the shield upper wall 65. One suitable electro-luminescent panel is type 94-0150-1 manufactured by Grimes Manufacturing Co., Urbana, Ohio.

To prevent build-up of static electrical charges on the electro-luminescent panel 70, the exposed or lower surface 71 or panel 70 is covered with a clear conductive material, preferably a thin layer 80 of NESA glass. Conductive layer 80 is electrically coupled to shield 63 through contact with side walls 66, 67 of shield 63. It will be understood that where shield 63 is formed from a non-conductive material, i.e. plastic conductive layer 80 may be dispensed with.

A preset reference signal, which appears in lead 91, is developed from a suitable d.c. voltage source shown in exemplary fashion as battery 110. Battery 110 is coupled across voltage level controller 90, controller 90 serving to regulate the voltage level of the reference signal in lead 91 in accordance with the setting thereof to provide a preset reference signal. The reference signal in lead 91 is applied via resistor 92 to one input of voltage comparator 93.

Power input to corona discharge wire 61 of supplemental charging section 52 and electro-luminescent panel 70 of charge reducing section 54 is derived from variable d.c. power source 74, the output of which to either section 52 or section 54 is regulated in accordance with charge conditions of the photosensitive surface 15 of belt 12 as sensed by a d.c. type electrometer 100. Probe 102 of electrometer 100 is mounted in machine 5 in predetermined spaced relationship to the photoconductive surface 15 as will be understood by those skilled in the art. In a preferred embodiment, probe 102 is disposed downstream of the charge control device 50 but before developing station 30. Other probe locations, however, may be contemplated.

The d.c. signal output from probe 102, representative of the charge on the photoconductive surface 15, is inputted via lead 103 to the main body 106 of electrometer 100 wherein the signal is suitably amplified. The signal output of electrometer 100 appears in lead 94 to d.c. power source 74. One type of d.c. electrometer is described in U.S. Pat. No. 3,852,668 issued on Dec. 3, 1974 in the name of James M. Hardenbrook et al. Other electrometers including those of the a.c. type may instead be contemplated.

Power source 74 includes a voltage comparator section 93, which may comprise any suitable circuit effective to compare voltage levels inputted thereto and generate an analog signal proportional to the difference between the input signal voltages. In the exemplary circuit illustrated, comparator 93 comprises an operational amplifier, operative to compare the preset control signal from voltage level controller 90 with the signal output of electrometer 100, the latter being representative of the charge level on the photoconductive surface 15 of belt 12.

The signal output of comparator 93 is applied via lead 96 to the base electrodes of PNP transistor 97 and NPN transistor 98 respectively. The collector of transistor 97 is connected by lead 99 to electro-luminescent panel 70. Lead 101 couples the emitter of transistor 97 to a suitable source of positive potential, represented herein by battery 112.

Lead 104 couples the collector of transistor 98 with the input side of a conventional d.c. to d.c. converter 105. The output of converter 105, which is used to drive charging section 52 of charge control device 50, is connected by lead 107 with corona generating wire 61. Lead 108 couples the emitter of transistor 98 with a suitable source of negative potential represented herein by battery 109.

D.C. to d.c. converter 105 serves to amplify the relatively low power variable signal output of transistor 98 to the relatively high power level required to drive charging section 52. Any suitable commercially available d.c. to d.c. converter having the necessary operating specifications may be used for this purpose.

In operation, the optimum charge level of the photoconductive surface 15 of belt 12 is determined, and the signal output of electrometer 100 corresponding to the optimum charge level is matched with the reference signal in lead 91. This may be effected by adjusting the setting of controller 90 until the matching signal potential is reached. So long as the charge level on the photoconductive surface 15 remains at the level desired, the signal inputs in leads 91, 94 to comparator 93 match, and the signal output from comparator 93 to lead 96 holds transistors 97, 98 in a blocking state. As a result, both the supplemental charging section 52 and charge reducing section 54 of charge control 50 are inoperative.

Should the charge level on the photoconductive surface 15 rise above the level desired, as represented by the setting of controller 90, the voltage potential of the output signal from electrometer 100 in lead 94 rises. Comparator 93 responds by generating a positive signal output, the potential of which is proportional to the difference in potential between the input signals to comparator 93 in leads 91, 94. Transistor 97 feeds a proportional amount of power to electro-luminescent panel 70 to turn panel 70 on and illuminate the photoconductive surface with an intensity proportional to the strength of the signal output from comparator 93. Light from panel 70 reduces the charge level on the photoconductive surface 15 to bring the charge level back to the optimum level desired.

Should the charge level on the photoconductive surface 15 fall below the optimum level desired, the voltage potential of the output signal from electrometer 100 in lead 94 falls. Comparator 93 responds by generating a negative signal output, the potential of which is proportional to the difference in potential between the signal inputs to comparator 93 in leads 91, 94. Transistor 98 feeds a proportional amount of power, which is raised to the requisite power level necessary by d.c. to d.c. converter, to corona discharge wire 61 of supplemental charging section 52. The resulting corona emissions from wire 61 add to or supplement the charge previously applied to the photoconductive surface 15 by corona generating device 13 to bring the charge level back to the optimum level desired.

While supplemental charging section 52 and charge reducing section 54 are combined herein to provide a unitary charge control 50, it will be understood that supplemental charging section 52 and charge reducing section 54 may comprise separate and discrete entities.

While the invention has been described with reference to the structure disclosed, it is not confined to the details set forth, but is intended to cover such modifications or changes as may come within the scope of the following claims.

What is claimed is:

1. In an electrostatic type reproduction machine for producing copies of an original, the machine having a photoreceptor, charging means for placing a charge on the photoreceptor in preparation for imaging, exposure means for exposing the charged photoreceptor to the original whereby to create a latent electrostatic image of the original on the photoreceptor, developing means for developing the latent electrostatic image on the photoreceptor, and transfer means for transferring the developed image to a sheet of copy material, the combination comprising:

light means for illuminating said photoreceptor to reduce the charge level of said photoreceptor;

supplemental charging means for increasing the charge on said photoreceptor;

a power source for said light means and said supplemental charging means;

means for monitoring the charge on said photoreceptor to produce a control signal proportional to the degree of overcharge or undercharge of said photoreceptor;

said monitoring means including means for generating a first signal reflecting the optimum charge for said photoreceptor, means for generating a second signal reflecting the existing charge on said photoreceptor, and comparator means for comparing said first and second signals to provide said control signal; and control means for proportionally actuating said light means and said supplemental charging means in response to said control signal, said control means including first control gate means responsive to a control signal of one polarity for regulating power input from said power source to said light means in proportion to the strength of said control signal; and second control gate means responsive to a control signal of the opposite polarity for regulating power input from said power source to said supplemental charging means in proportion to the strength of said control signal.

* * * * *